United States Patent [19]

Schuring, Jr.

[11] 4,026,220

[45] May 31, 1977

[54] PLANT STAND

[76] Inventor: John O. Schuring, Jr., 1322 Boston, SE., Grand Rapids, Mich. 49507

[22] Filed: Jan. 8, 1976

[21] Appl. No.: 647,351

[52] U.S. Cl. ..... 108/101; 47/39; 108/111; 211/74; 211/78; 211/186; 224/45 R; 248/150

[51] Int. Cl.[2] ..... A47G 7/02; A47F 7/28; A47B 47/00; A47B 49/00

[58] Field of Search ..... 211/71, 74, 77, 78, 211/126, 128, 129, 131, 133, 144, 148, 163, 128, 186, 188, 189, 194, 205; 248/127, 150, 165; 108/92, 101, 111; D35/3 C; 47/39; 224/48 R, 48 A, 48 D, 48 E, 48 F, 46 T, 45 G

[56] References Cited

UNITED STATES PATENTS

| | | | |
|---|---|---|---|
| 283,840 | 8/1883 | Westphal | 211/129 X |
| 311,408 | 1/1885 | Butcher | 211/186 X |
| 1,047,882 | 12/1912 | Beach | 248/165 X |
| 1,719,708 | 7/1929 | Luber | 211/186 X |
| 1,884,970 | 10/1932 | Davis | 248/165 X |
| 2,510,591 | 6/1950 | Listman | 211/74 X |
| 2,595,002 | 4/1952 | Schneider | 108/101 |
| 2,615,771 | 10/1952 | Curtis | 248/165 X |
| 2,626,059 | 1/1953 | Turner | 211/189 X |
| 2,938,633 | 5/1960 | Schmidt et al. | 108/101 |
| 3,338,189 | 8/1967 | Xavier | 108/111 |
| 3,695,457 | 10/1972 | Cohen | 211/189 |

FOREIGN PATENTS OR APPLICATIONS

| | | | |
|---|---|---|---|
| 21,276 | 7/1929 | Australia | 211/186 |
| 542,087 | 6/1957 | Canada | 211/186 |
| 1,354,306 | 12/1964 | France | 211/186 |
| 453,488 | 9/1936 | United Kingdom | 108/101 |
| 213,793 | 4/1924 | United Kingdom | 211/128 |
| 802,248 | 10/1958 | United Kingdom | 211/188 |
| 710,460 | 6/1954 | United Kingdom | 211/148 |

*Primary Examiner*—Edgar S. Burr
*Assistant Examiner*—Steven A. Bratlie
*Attorney, Agent, or Firm*—McGarry & Waters

[57] ABSTRACT

A portable plant stand for holding potted plants is formed of easily assembled flat wood components. The stand comprises a tapered vertical support column that supports horizontal shelves having pot holding openings. The shelves include central apertures that fit over the support column and engage the tapered sides of the support column. The support column has an H-shaped cross section and comprises opposed tapered members and a tapered cross member that is removably fastened to the side members by two screws. The support column can be mounted on bearings to permit rotation of the plant stand.

11 Claims, 9 Drawing Figures

PLANT STAND

BACKGROUND OF THE INVENTION

1. Field of the Invention

The present invention relates to a portable plant stand having a tapering support column and suspended shelves supported by the outer edges of the tapering support column.

2. Description of the Prior Art

One type of plant stand for supporting potted plants includes a vertical support column and horizontal shelves fixed at various positions along the support column. A plant stand disclosed in Slocum U.S. Pat. No. 163,417 includes a slightly tapered tubular metal support column with circular shelves attached by means of collars along the support column. The support column is hollow and perforated and a heat source is placed under the open lower end of the support column to heat the plants. Westphal U.S. Pat. No. 283,840 discloses another type of plant stand employing a slightly tapered tubular metal support column and horizontal shelves which are rotatably mounted on the support column. The support column also is mounted on casters.

The foregoing plant stands are formed principally of pre-formed metal components and appear to be expensive and complex, and not easily assembled and disassembled.

SUMMARY OF THE INVENTION

In accordance with the present invention, an inexpensive and easily assembled portable plant stand for holding potted plants comprises a tapered support column including at least two interconnected elongated support members that extend upwardly from the bottom to the top of the support column and form the outer sides thereof. The support members are formed and interconnected such that the support column tapers inwardly as it extends from bottom to top. At least one shelf for holding plants is removably mounted on the support column. The shelf has an aperture therein that fits over the support column, the aperture being formed such that the tapered support column engages the sides of the shelf around the aperture and supports the shelf at a predetermined position along the support column.

The support column of the present invention includes a pair of opposed flat side members connected together by at least one flat center member that extends between the side members. The side members are releasably attached to the outer edges of the center member to permit easy assembly and disassembly of the support column. The side edges of the side members or the center member are tapered inwardly from the bottom to the top so that the support column tapers inwardly from bottom to top. Preferably, both the side members and the center member are tapered inwardly in this manner.

The shelves are supported on the support column by engagement of the edge of the shelf surrounding the aperture with the tapered outer surface of the support column.

The support column preferably is formed of three flat wooden members connected together so as to give the support column an H-shaped cross section. Each side member includes a pair of spaced cleats that hold the center member in a predetermined transverse position with respect to the side member. A single screw can be employed to attach each side member to the edge of the center member.

A base rail can be attached to the bottom of each side member for increasing the stability of the stand. Also, the support column can be mounted on a rotatable base assembly so that the entire plant stand is rotatable about a vertical axis.

The entire assembly can be fabricated from flat wooden pieces and packaged compactly for easy shipment. The support platform can be easily assembled and disassembled by means of two screws, one attaching each side to the center member. The shelves (which may be two or three shelves, depending upon the height of the support column) can then be mounted on the plant stand without any fasteners simply by placing the shelves over the top of the support column.

These and other advantages and features of the present invention will hereinafter appear, and, for purposes of illustration, but not of limitation, preferred embodiments of the present invention are described below and shown in the appended drawings. BRIEF DESCRIPTION OF THE DRAWINGS FIG. 1 is a perspective view of the present invention.

DETAILED DESCRIPTION OF THE PREFERRED EMBODIMENTS

Figure 1:
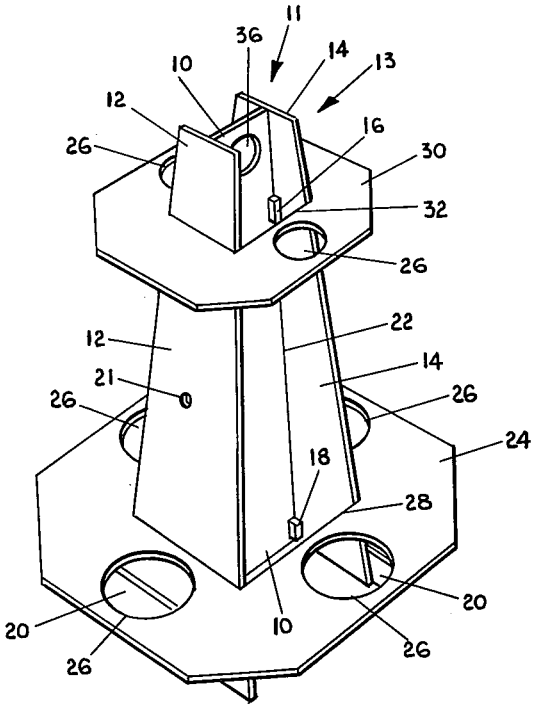
Figure 2:
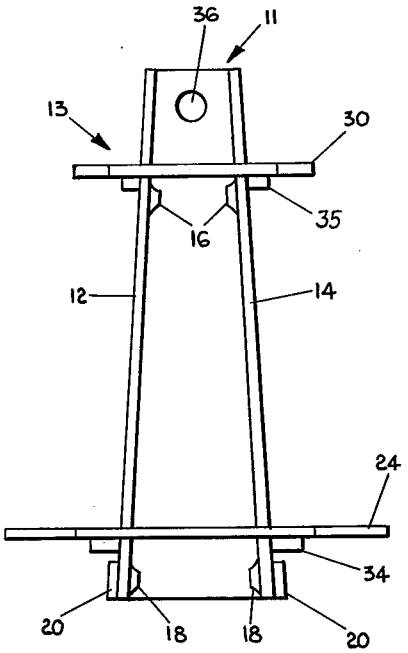
FIG. 2 is a front elevational view of the present invention.
Figure 4:
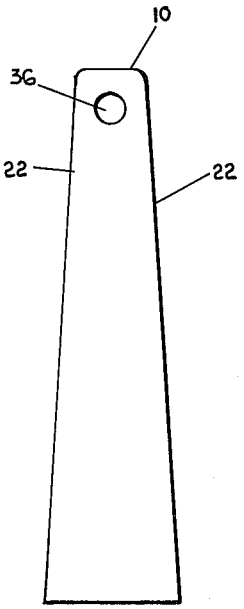
FIG. 4 is a plan view of the center member of the present invention.

Referring to the drawings, a plant stand 13 constructed in accordance with the present invention has a tapered support column 11 which is made from three members, a center member 10, a left side member 12, and a right side member 14. Each member is preferably formed of flat wood, with straight edges and plane surfaces, and is tapered inwardly toward its top. Each side member is atttached at the center of its inside surface to a side edge 22 of the center member 10 by means of a single screw 21. This makes assembly and disassembly of the stand an easy task and makes it possible to package the components of the stand in kit form in a compact, flat package. A bottom pair of spaced cleats 18 and a top pair of spaced cleats 16 are attached to the inside surfaces of the side members 12 and 14 abutting the center member 10 in order to properly position the center member with respect to the side members.

Figure 3:
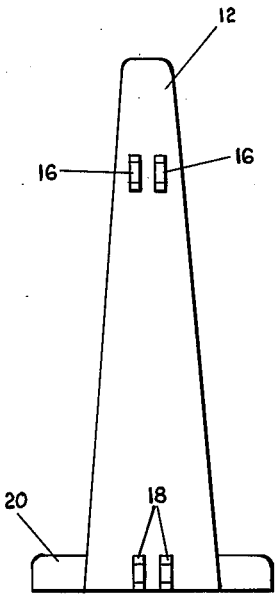
FIG. 3 is a plan view of the side member of the present invention.

A cross-sectional view of the assembled support column resembles the capital letter "H". At the bottom of the support column 11 is a base runner 20 attached to the outside surface of each side member 12 and 14. As shown in FIG. 3, the base runner 20 extends beyond the side edges of the side members 12 and 14 of the support column 11.

Figure 5:
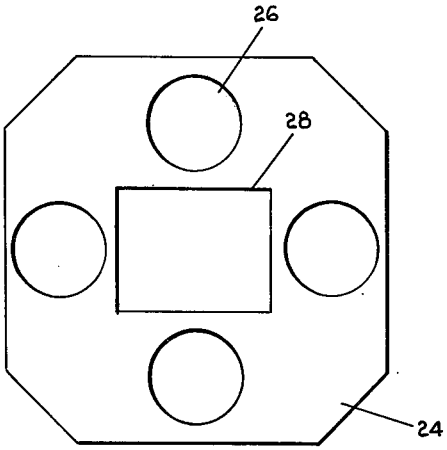
FIG. 5 is a top plan view of the bottom shelf of the present invention.
Figure 6:
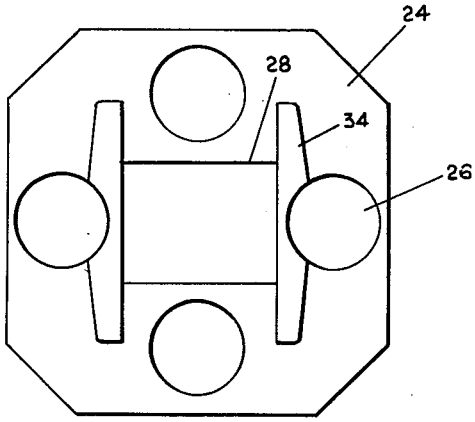
FIG. 6 is a bottom plan view of the bottom shelf of the present invention.
Figure 7:
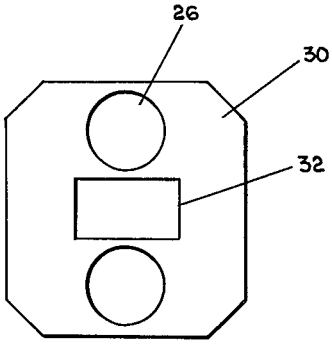
FIG. 7 is a top plan view of the top shelf of the present invention.

A bottom shelf 24 is mounted near the bottom of the tapered support column 11. As seen in FIG. 5, the bottom shelf has an octagonal outer configuration and has four circular openings 26 spaced around the shelf for holding potted plants. A rectangular aperture 28 is formed in the center of the shelf so as to fit over the support column. As shown in FIG. 6, two braces 34 are attached to the bottom surface of the shelf 24 adjacent opposite sides of the rectangular aperture. Bottom shelf 24 is mounted on the support column by fitting the shelf over the top of the support column 11 and moving the shelf downwardly to a point where the outer surfaces of the support column contact the edges of the central aperture 28. The braces 34 abut the side members 12 and 14 when the shelf 24 is wedged on the tapered support column and add to the stability of the shelf.

Figure 8:
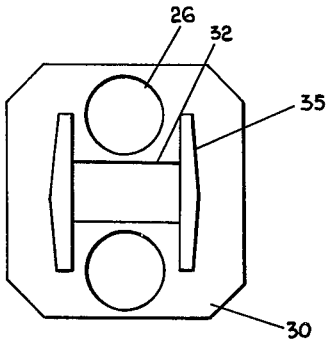
FIG. 8 is a bottom plan view of the top shelf of the present invention.

A top shelf 30 is also attached to the tapered support column 11 in the same manner as bottom shelf 24. The top shelf is of the same shape as the bottom shelf but is smaller than the bottom shelf. The upper shelf has a rectangular central aperture 32 for mounting the shelf on the support column and two circular openings therein for holding potted plants. The rectangular aperture 32 is smaller than the rectangular aperture 28 formed in the bottom shelf. As seen in FIG. 8, braces 35 are attached to the bottom surface of the shelf 30 and are aligned with two opposing edges of the rectangular aperture 32.

Top shelf 30 is mounted on the support column 11 in the same fashion as the bottom shelf 24. The outer plane surfaces of the side members 12 and 14 and its side edges will abut the braces 35 and the edges of the rectangular aperture 32 to rigidly support the top shelf 30. Due to the difference in size of the aperture 32, the top shelf will be supported near the top of the support column 11.

For convenience in handling and carrying the plant stand, an aperture or hand opening 36 is inserted through the top portion of the center member 10 of the tapered support column 11.

Figure 9:
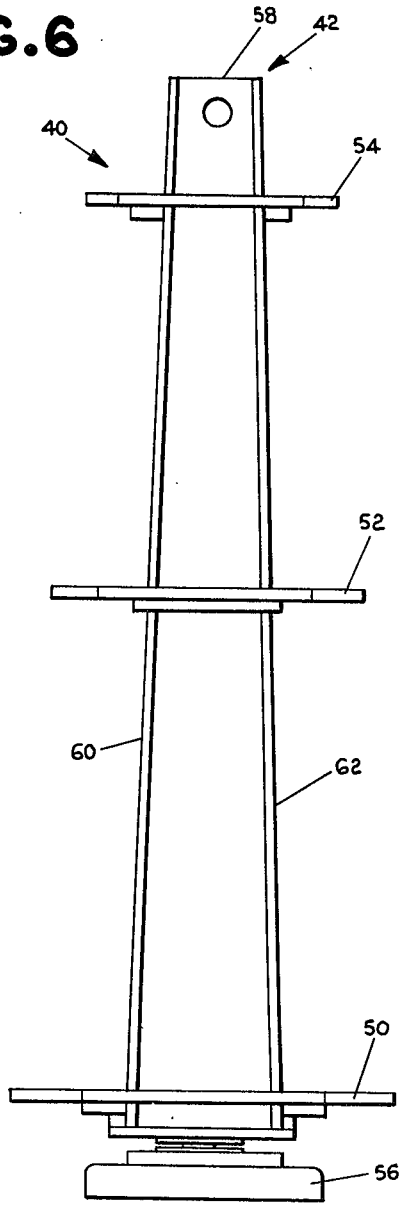
FIG. 9 is a front elevational view of a second embodiment of the present invention.

In another embodiment 40 of the invention, as seen in FIG. 9, a tapered support column 42 comprises side members 60 and 62 and center member 58 fastened together in the same manner as the sides and center member of support column 11. The principal difference between plant stand 40 and plant stand 13 is that support column 42 is taller than support column 11 in order to allow three shelves 50, 52, and 54 to be mounted on the support column with adequate space between the shelves. Another feature of the plant stand 40 is that the tapered support column is attached to a weighted rotating pedestal 56 instead of the runner base 20. The weighted rotating pedestal 56 allows the plant stand to revolve around its vertical axis so the position of the plants can be easily changed when desired. For example, when sun light is striking one side of the plant stand, the stand can be revolved to the side which is desired to receive the sunlight.

It should be understood that the foregoing embodiments of the present invention are merely illustrative of the preferred practice of the present invention and that various changes and modifications may be made in the arrangements and details of construction of the embodiments described herein without departing from the spirit and scope of the present invention.

The embodiments of the invention in which an exclusive property or privilege is claimed are defined as follows:

1. A portable plant stand comprising:

a tapered support column including two opposed side sections with a center section extending perpendicularly between and supporting the side section, the center and side sections being formed and interconnected such that the support column has a generally H-shaped horizontal cross section, the center and side sections being formed such that the support column tapers upwardly and inwardly from the bottom to the top of the support column;

at least one plant-holding shelf removably mounted on the support column, said plant-holding shelf having a central aperture therein that fits over the top of the tapered support column such that at least a portion of the shelf at the outer periphery of the aperture engages the outer side of the tapered support column at a predetermined position along the tapered support column, the shelf being supported at such position by wedging engagement of the shelf with the outer side of the tapered column.

2. A portable plant stand formed of easily interconnectable flat components comprising:

a tapered support column including:

a flat vertical center member having upwardly and inwardly tapered side edges on opposite sides thereof;

two flat opposed side members having parallel inner and outer surfaces and upwardly and inwardly tapered side edges on opposite sides thereof, the inner surfaces being opposed to each other and engaging the tapered side edges on opposite sides of the center member approximately half-way between the side edges of the side members, such that the support column has a generally H-shaped horizontal cross-section, the side members being supported by said center member and being inclined inwardly and upwardly when so supported such that the outer surfaces thereof are inwardly and upwardly inclined; and interlocking means for releasably fitting the side members against the center member such that lateral movement of the center member with respect to the side members is restrained when the center member is in supporting engagement with the opposed side members;

at least two plant-holding shelves removably mounted on the support column, each said plant-holding shelf having a rectangular central aperture therein that fits over the top of the tapered support column such that the portions of the shelf opposite the inclined outer surfaces of the side members engage said inclined outer surfaces, each shelf having an aperture of a different size such that the shelf is supported at a different position along the support column, the engagement between the shelves and the support column exerting an inward force on the opposed side members that is sufficient to hold the side members in fitting engagement with the center member with no more than a single threaded screw fastener interconnecting each side member with the center member, the shelves each having a plurality of plant-holding opening means around the periphery thereof for holdng potted plants, each shelf includng a brace member attached to the underside of the shelf at the edge of the central aperture adjacent the outer surface of each side member, said brace members reinforcing the stability of the shelf on the support column; and a base support attached to the outer surface of each side member at the bottom end thereof and extending outwardly past the side edges of the side member, the base supports enhancing the stability of the support column.

3. A portable plant stand according to claim 2 wherein the plant stand includes three plant holding shelves and is mounted on a rotatable base.

4. A portable pland stand comprising:

a tapered support column including:

a vertical center section having upwardly and inwardly tapered side edges on opposite sides thereof;

two opposed side members having relatively wide inner and outer surfaces with relatively narrow side edges on opposte sides thereof, the inner surfaces being opposed to each other and engaging opposite tapered side edges of the center section at a position on the inner surfaces between and spaced inwardly away from the side edges of the side members, forming a generally H-shaped horizontal cross sectional support column the side members being inclined upwardly and inwardly against the center section such that the outer surfaces form upwardly and inwardly inclined outer sides of the support column; and interlocking means for releasably fitting the side members against the center section such that lateral movement of the center section with respect to the side members is restrained when the opposed side members are fitted against the opposite side edges of the center section; and at least one plant-holding shelf removably mounted on the support column, said plant-holding shelf having a central aperture therein that fits over the top of the tapered support column such that at least a portion of the shelf at the outer periphery of the aperture engages the outer surfaces on the side members of the support column at a predetermined position along the support column, the shelf being supported at such position by such engagement, said shelf when so positioned exerting an inward force on the opposed side members so as to hold the side members in engagement with the center section.

5. A portable plant stand according to claim 4 wherein the center section and side members are flat members and are interconnected such that the center section engages at right angles the inner surfaces of the side members approximately half-way between the side edges thereof, the side edges of the side members being tapered upwardly and inwardly.

6. A plant stand according to claim 5 wherein the aperture in the shelf is rectangular and is formed such that the edge of the shelf at opposite sides of the rectangular aperture engage the outer surfaces of the opposed side members, with the corners of the rectangular aperture engaging the side edges of the opposed side members, the shelf being supported on the tapered column by a wedging action of the shelf downwardly onto the tapered support column.

7. A plant stand according to claim 6 wherein the plant-holding shelf includes a plurality of opening means therein for holding potted plants.

8. A portable plant stand according to claim 7 wherein the interlocking means comprises spaced cleats attached to the inner surface of each side member adjacent the mid-points thereof between the side member side edges, the spaced cleats being formed so as to be located at opposite sides of each side edge of the center section and prevent the center section from lateral movememt with respect to the side members when the center section is in supporting engagement with the side members.

9. A plant stand according to claim 8 wherein the shelf rests securely on the support column without the need of fasteners to fix the shelf in place.

10. A plant stand according to claim 9 wherein the center section includes a handle opening at the top end thereof and the plant stand includes at least two plant-holding shelves, with the shelves having different sized central apertures such that the shelves are supported at different positions along the support column.

11. A plant stand according to claim 4 wherein the center section and side members are formed and interconnected in such a manner that each side member requires no more than a single screw fastener to fasten the side to the center section in order to provide a sturdy plant stand at least when the plant-holding shelf is in place.

* * * * *